US008511502B2

(12) United States Patent
Wong

(10) Patent No.: US 8,511,502 B2
(45) **Date of Patent: *Aug. 20, 2013**

(54) LITTER BIN WITH PIVOTAL LID AND AUTOMATIC LATCHING MECHANISM

(75) Inventor: Michael P. Wong, Phoenix, AZ (US)

(73) Assignee: Rehrig Pacific Company, Los Angeles, CA (US)

( * ) Notice: Subject to any disclaimer, the term of this patent is extended or adjusted under 35 U.S.C. 154(b) by 31 days.

This patent is subject to a terminal disclaimer.

(21) Appl. No.: 12/467,589

(22) Filed: May 18, 2009

(65) Prior Publication Data

US 2009/0218350 A1 Sep. 3, 2009

Related U.S. Application Data

(63) Continuation of application No. 10/952,157, filed on Sep. 27, 2004, now Pat. No. 7,540,393.

(51) Int. Cl.
*B65D 45/16* (2006.01)

(52) U.S. Cl.
USPC ..... 220/324; 220/326; 220/833; 220/835; 220/908; 292/230; 292/304; 292/DIG. 4

(58) Field of Classification Search
USPC ..... 220/324, 495.06, 833, 9.1–9.4, 908, 220/315, 326, 835; 232/38, 39, 44; 292/130, 292/183, 230, 238, 304, 341.17, DIG. 11, 292/DIG. 4; D34/7, 8, 10, 11
See application file for complete search history.

(56) References Cited

U.S. PATENT DOCUMENTS

| | | | | |
|---|---|---|---|---|
| 1,364,209 | A | | 1/1921 | Richardson |
| 1,380,252 | A | | 5/1921 | Richardson |
| 1,424,250 | A | | 8/1922 | Richardson et al. |
| 1,424,519 | A | | 8/1922 | Richardson |
| 1,424,520 | A | * | 8/1922 | Richardson et al. ..... 220/254.2 |
| 2,969,891 | A | | 1/1961 | Presnick |
| D229,279 | S | | 11/1973 | Kay et al. |
| 3,793,756 | A | | 2/1974 | Kay et al. |
| 3,803,738 | A | | 4/1974 | Weiss |
| D234,288 | S | | 2/1975 | Kay et al. |
| 4,155,584 | A | | 5/1979 | Pracchia |
| 4,182,530 | A | | 1/1980 | Hodge |
| RE30,890 | E | | 3/1982 | Hodge |
| D265,542 | S | | 7/1982 | Hanson et al. |
| D312,523 | S | | 11/1990 | Delmerico et al. |
| 5,011,360 | A | | 4/1991 | Abram et al. |
| 5,015,021 | A | | 5/1991 | Wyson et al. |
| 5,041,728 | A | | 8/1991 | Spacher et al. |
| 5,042,856 | A | | 8/1991 | Goodman |
| 5,085,341 | A | | 2/1992 | Hodge |
| 5,094,358 | A | | 3/1992 | Serio, Sr. |
| 5,094,487 | A | | 3/1992 | Drewry |
| 5,105,967 | A | | 4/1992 | Horpestad |

(Continued)

*Primary Examiner* — J. Gregory Pickett
*Assistant Examiner* — Ned A Walker
(74) *Attorney, Agent, or Firm* — Carlson, Gaskey & Olds

(57) ABSTRACT

A litter bin includes a lid hingeably connected to a container. Opposite the hinge, a latch selectively secures the lid to the container. The latch includes a pivotably mounted latch member that has a center of gravity offset from its pivot point. The latch member also includes a catch portion that moves between a locked position and an unlocked position upon pivoting of the latch member. Because the center of gravity of the latch member is offset from the pivot point, tilting the litter bin causes pivoting of the latch member, thereby moving the catch portion from the locked position to the unlocked position.

11 Claims, 9 Drawing Sheets

(56) References Cited

U.S. PATENT DOCUMENTS

| | | | | |
|---|---|---|---|---|
| 5,118,000 | A | 6/1992 | Howell et al. | |
| 5,135,129 | A | 8/1992 | Joly | |
| 5,149,153 | A | 9/1992 | Drewry et al. | |
| 5,201,434 | A | 4/1993 | DeVivo et al. | |
| 5,217,267 | A | 6/1993 | Yagi | |
| 5,224,744 | A | 7/1993 | Michelutti | |
| D346,056 | S | 4/1994 | Keeney | |
| 5,415,314 | A | 5/1995 | McCollum | |
| 5,423,419 | A | 6/1995 | Wentz et al. | |
| 5,474,341 | A | 12/1995 | Putman et al. | |
| 5,490,606 | A | 2/1996 | Lombardo | |
| 5,599,050 | A | 2/1997 | Tinsley | |
| 5,662,364 | A | 9/1997 | Reeb et al. | |
| 5,683,126 | A | 11/1997 | De Vivo et al. | |
| 5,738,395 | A | 4/1998 | Probst | |
| 5,772,061 | A | 6/1998 | Lowe | |
| 5,772,264 | A | 6/1998 | Bettenhausen | |
| 5,997,052 | A | 12/1999 | Reeb et al. | |
| 6,176,388 | B1 | 1/2001 | Orndorff | |
| 6,290,093 | B1 | 9/2001 | Obriot et al. | |
| D465,312 | S | 11/2002 | Perelli et al. | |
| 6,666,485 | B1 | 12/2003 | Moret | |
| D487,539 | S | 3/2004 | Moroney | |
| 6,808,080 | B2 | 10/2004 | Spiers et al. | |
| D537,222 | S | 2/2007 | Presnell | |
| D551,414 | S | 9/2007 | Weiss | |
| 7,988,009 | B2 * | 8/2011 | Cavalcante | 220/324 |
| 2003/0168466 | A1 | 9/2003 | Spiers et al. | |
| 2006/0180588 | A1 | 8/2006 | Cavalcante | |

* cited by examiner

LITTER BIN WITH PIVOTAL LID AND AUTOMATIC LATCHING MECHANISM

This application is a continuation of U.S. patent application Ser. No. 10/952,157, filed on Sep. 27, 2004.

BACKGROUND OF THE INVENTION

This invention relates to litter bins and more particularly to a litter bin having a gravity activated lock for a lid.

Litter bins are often used in outdoor environments and include a container defining an opening over which a lid is removably attached. Side openings in the lid and/or container permit people to throw away litter into the container. The lid must be removed to empty the litter bin. Some litter bins includes manually actuated latches to secure the lid to the container. This makes it more difficult to removed the lid and empty the litter bin. In particular, this makes it difficult for automated handling equipment to lift and empty the contents of the litter bins.

SUMMARY OF THE INVENTION

A litter bin according to the present invention includes a lid hingeably connected to a container. Opposite the hinge, a latch normally keeps the lid latched to the container. The latch is gravity-actuated, such that the lid is released when the litter bin is tilted sufficiently, thus making it easy to open the lid and empty the litter bin.

The latch includes a pivotably mounted latch member that has a center of gravity offset from its pivot point. The latch member also includes a catch portion that moves between a locked position and an unlocked position upon pivoting the latch member. Because the center of gravity of the latch member is offset from the pivot point, tilting the litter bin causes pivoting of the latch member, thereby moving the catch portion from the locked position to the unlocked position.

Because the latch is gravity-actuated, the lid is released automatically simply by tilting the litter bin while emptying it. Therefore, automated handling equipment need only lift and tilt the litter bin to empty it, without having to actuate the latch separately.

BRIEF DESCRIPTION OF THE DRAWINGS

Other advantages of the present invention can be understood by reference to the following detailed description when considered in connection with the accompanying drawings wherein.

DETAILED DESCRIPTION OF THE PREFERRED EMBODIMENTS

Figure 1:
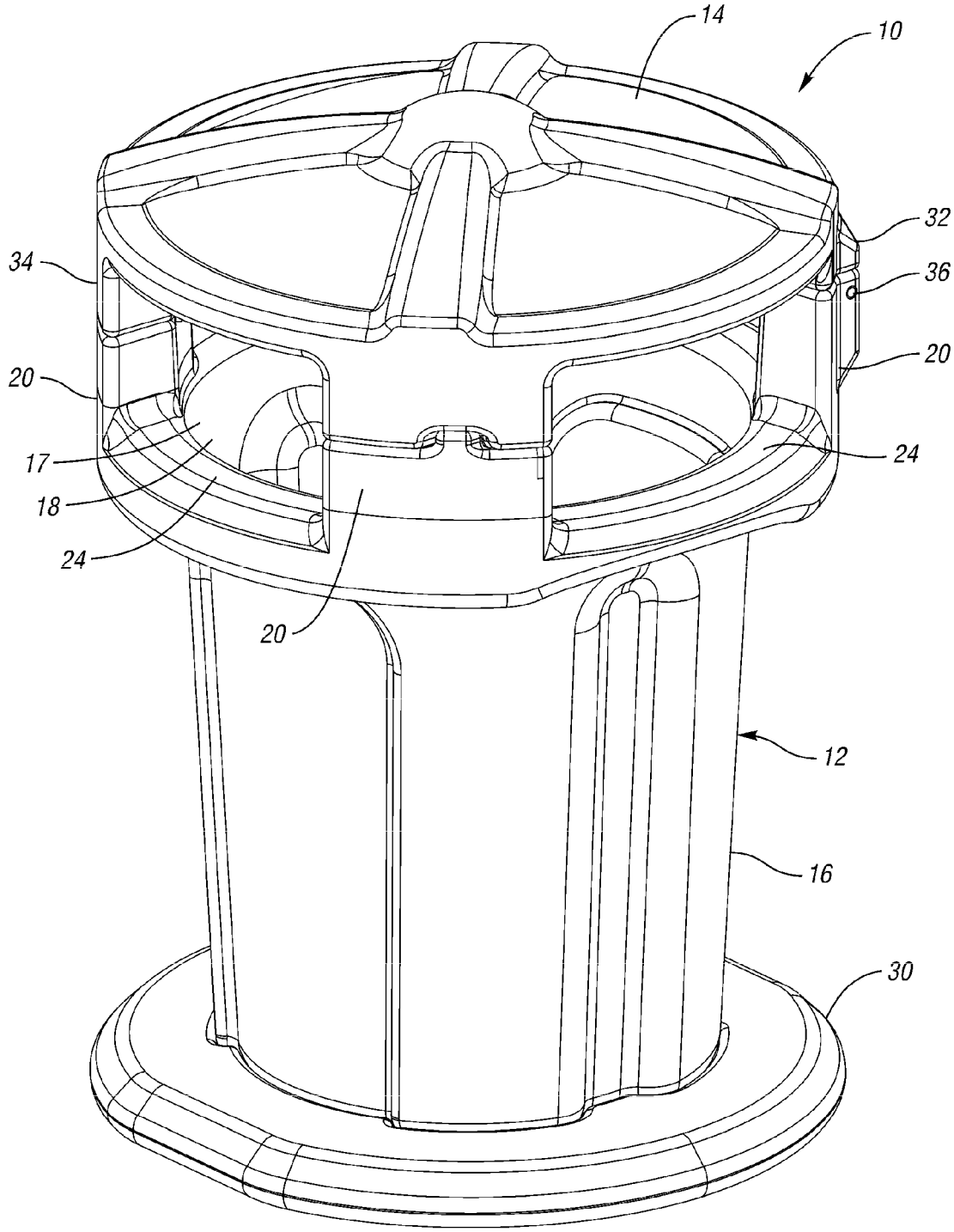
FIG. 1 is a perspective view of a litter bin according to the present invention.

A litter bin 10 is shown in FIG. 1 including a body or container 12 with a lid 14 attached thereto. The container 12 includes a roughly cylindrical wall 16 defining an interior 17 and an opening 18 at the upper end of the wall 16 leading to the interior 17. A plurality of columns 20 extend upwardly from the wall 16, thereby defining openings 24. A base 30 is mounted to a lower end of the wall 16. While the embodiment show herein is directed to a litter bin, it is understood that the concepts described and shown herein could also apply to various container/lid combinations.

Figure 2:
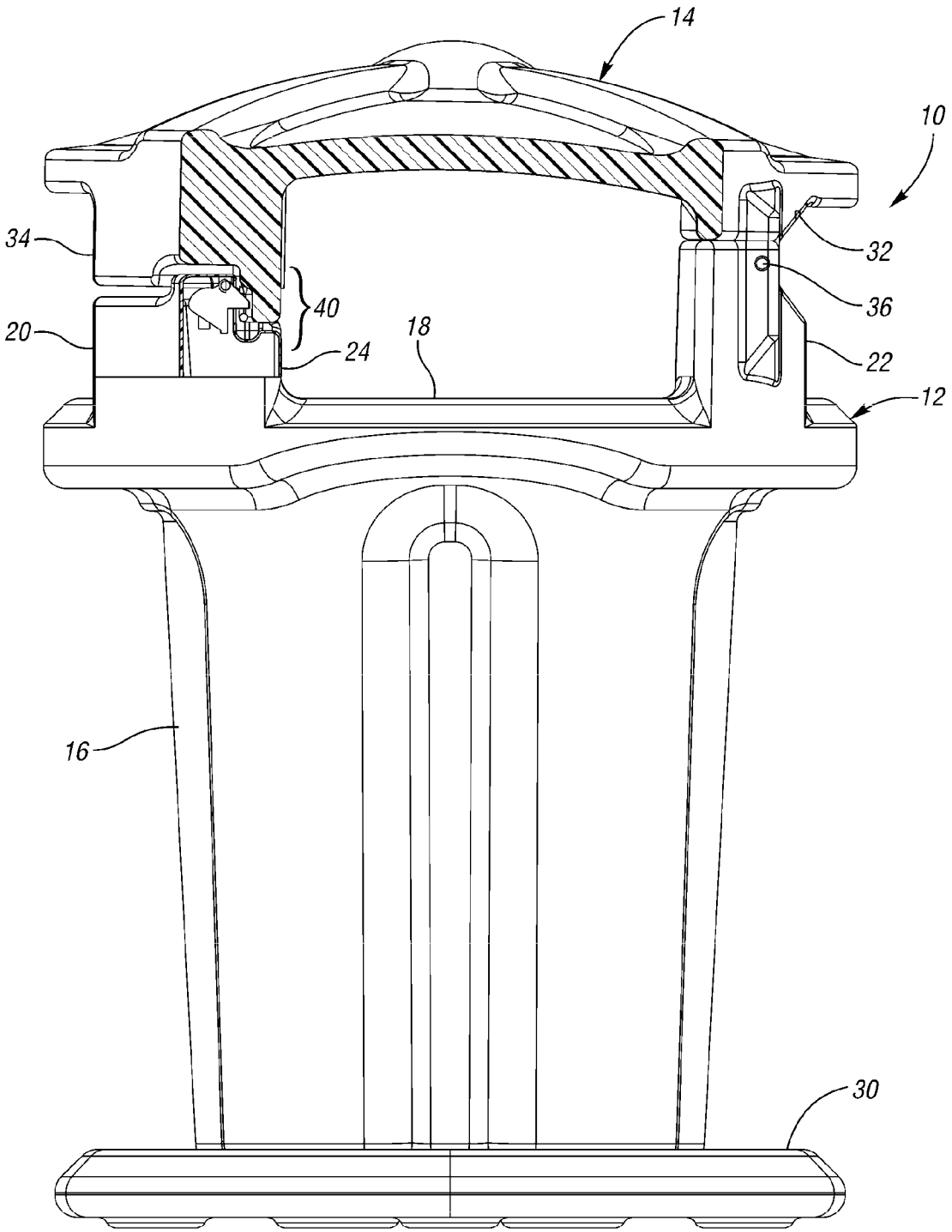
FIG. 2 is a side view, partially broken away, of the litter bin of FIG. 1.

The lid 14 has a rearward end 32 opposite a forward end 34 that extends downwardly and mates with a column 20 extending upwardly from the container 12. The rearward end 32 of the lid 14 is connected to another column 20 of the container 12 via a hinge 36. As shown in FIG. 2, the forward end 34 of the lid 14 is releasably secured to the column 20 of the container 12 via a latch system 40.

Figure 3:
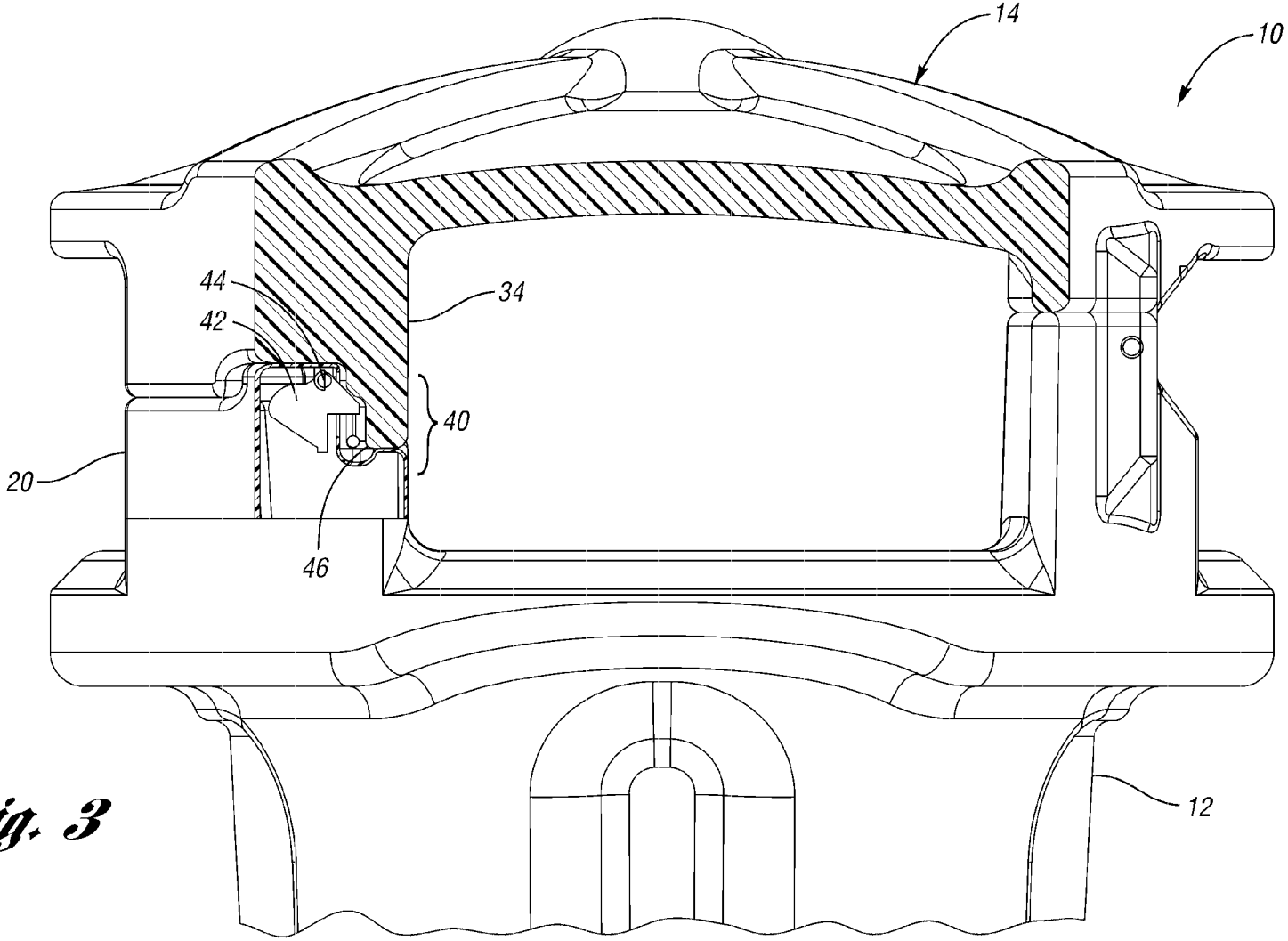
FIG. 3 is an enlarged view of the hinge and latch area of FIG. 2.

Referring to FIG. 3, the latch system 40 generally includes a latch member 42 pivotably mounted to the column 20 of the container 12 by a pivot pin 44. The latch further includes a latch receiver 46 at a lower end of the forward end 34 of the lid 14.

Figure 4:
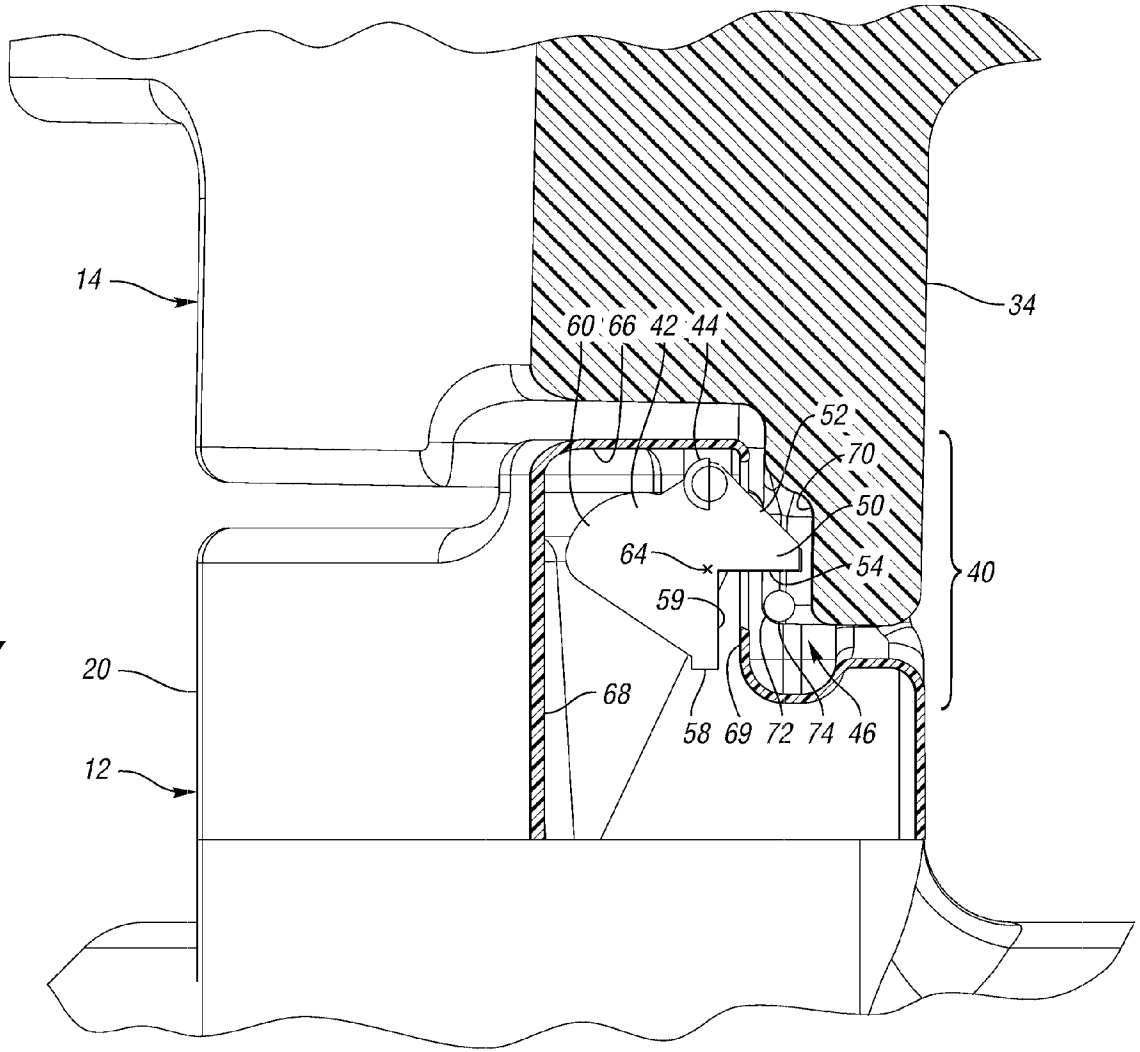
FIG. 4 is an enlarged view of the latch of FIG. 3, with the latch in a latched position.

FIG. 4 is an enlarged view of the latch of FIG. 3, with the latch in a latched position. The latch member 42 includes a catch portion 50 extending outwardly away from the pivot pin 44. The catch portion 50 includes an inclined leading upper edge 52 adjacent a horizontal shoulder 54. The latch member 42 further includes a leg portion 58 extending vertically downward from the pivot pin 44 and defining a large recess 59 between the leg portion 58 and the shoulder 54 of the catch portion 50. A large abutment member 60 protrudes rearwardly from the latch member 42 away from the pivot pin 44. The shape, size and thickness of the various portions of the latch member 42 are determined such that the center of gravity 64 of the latch member 42 is positioned directly below the pivot pin 44 and is spaced substantially away from the pivot pin 44.

The latch member 42 is pivotably mounted on pivot pin 44 within a recess 68 inside the column 20 of the container 12. The recess 68 includes an upper surface 66 for contact by the abutment member 60 to limit rotation of the latch member 68 in that direction. The recess 68 also includes a forward stop 69 below the shoulder 54 of the catch portion 50 and in front of the leg portion 58.

Figure 5:
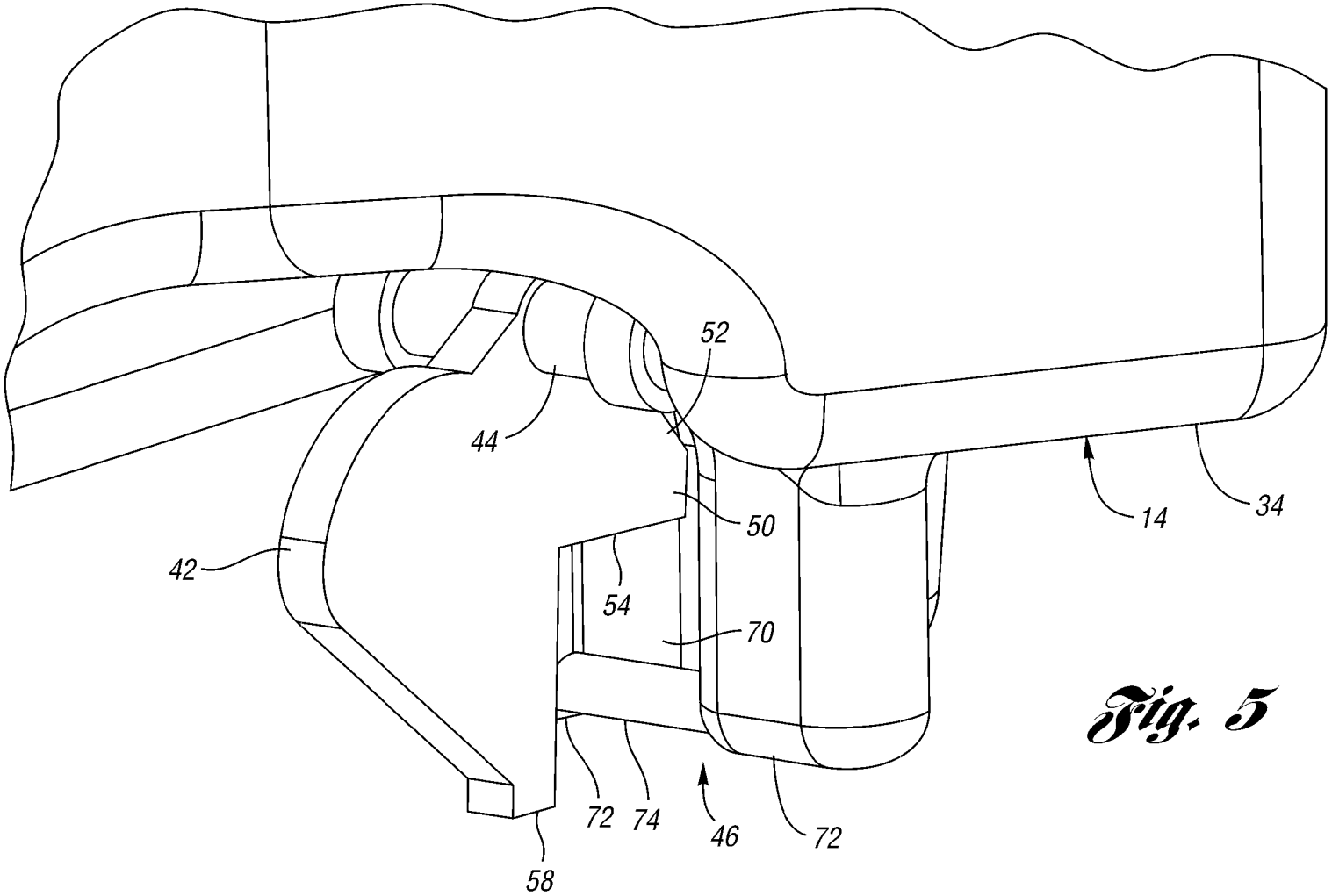
FIG. 5 is perspective view of the latch of FIG. 4.

As can be seen in FIGS. 4 and 5, the latch receiver 46 includes a recess 70 between a pair of spaced apart arms 72 extending downwardly from the forward end 34 of the lid 14. A stop pin 74 is mounted between the arms 72. In the latched position shown in FIGS. 4 and 5, the catch portion 50 of the latch member 42 is disposed in the recess 70 of the latch receiver 46 with the shoulder 54 of the catch portion 50 disposed above the stop pin 74.

Figure 6:
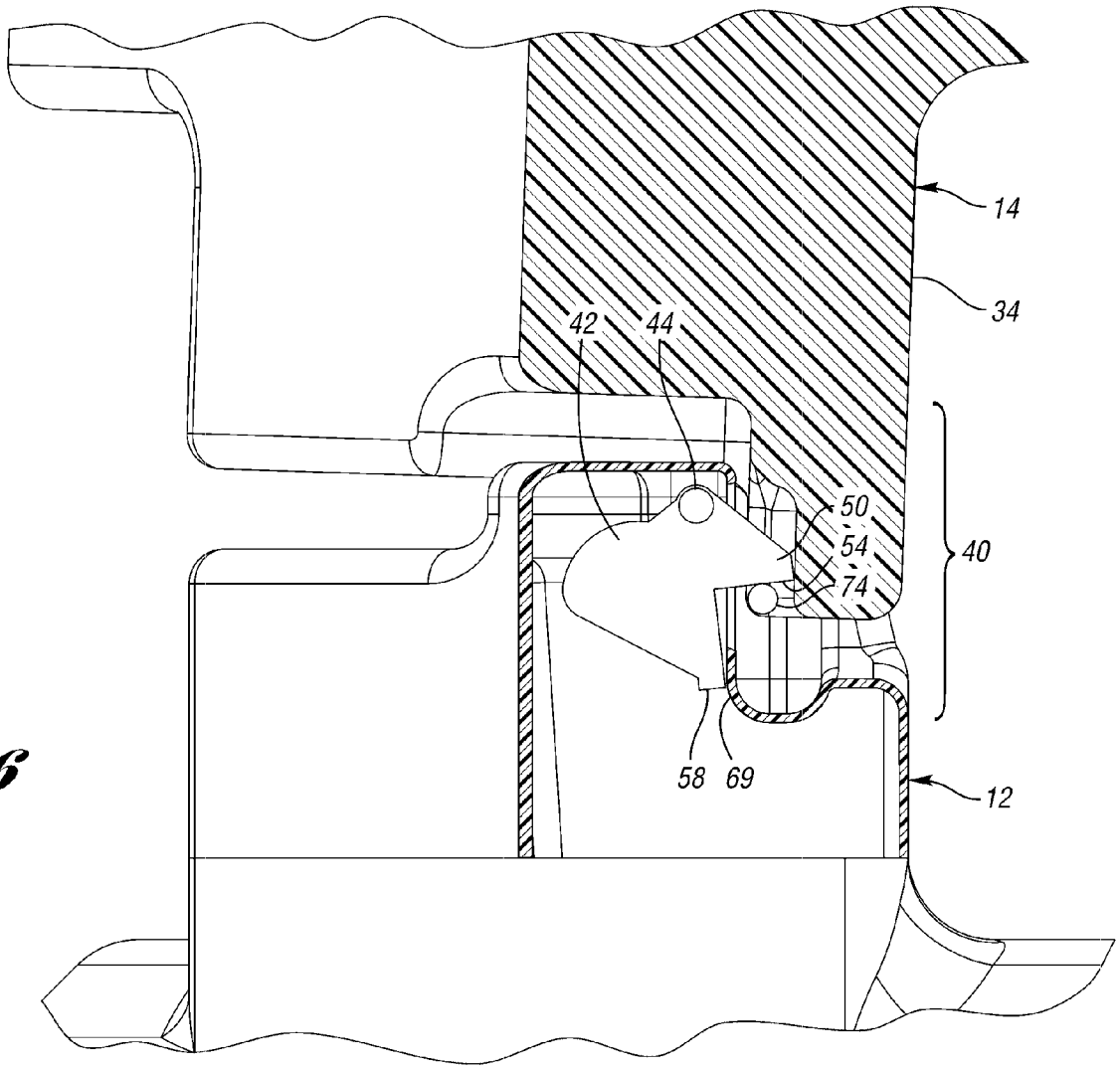
FIG. 6 shows the latch in a view similar to that of FIG. 4, with the latch preventing opening of the lid.

FIG. 6 shows the latch system 40 preventing opening of the lid 14. When the catch portion 50 is in the latched position shown in FIGS. 4 and 5 and the lid 14 is lifted, the stop pin 74 contacts the shoulder 54 of the catch portion 50. This causes the latch member 42 to rotate slightly until the leg portion 58 contacts the forward stop 69, thereby prohibiting further rotation in that direction and, consequently, prohibiting lifting the lid 14 any further.

Figure 7:
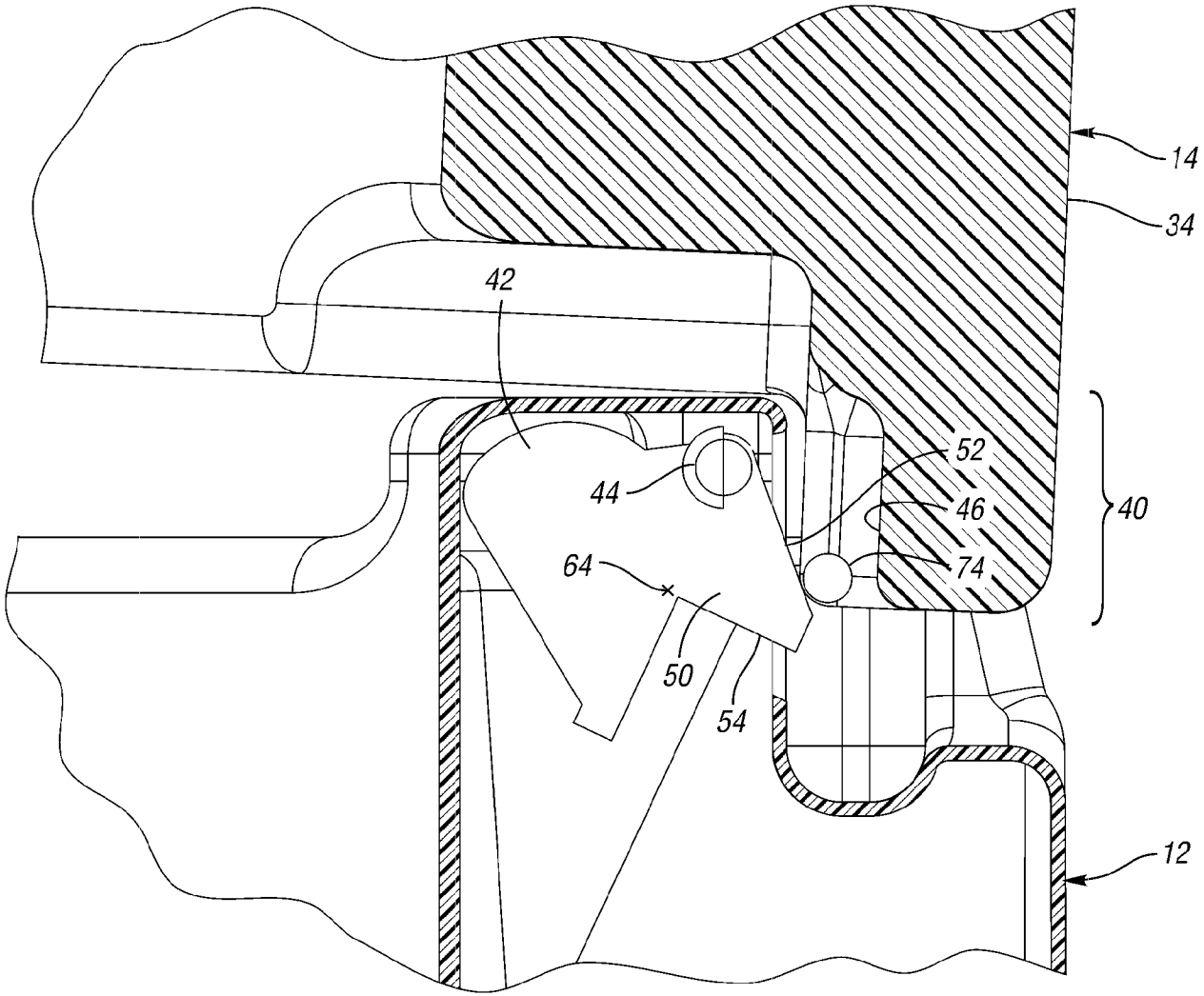
FIG. 7 shows the latch permitting closing of the lid.

The latch system 40 permits the lid 14 to be closed as shown in FIG. 7. When the lid 14 is moved downwardly, the stop pin 74 contacts the inclined leading upper edge 52 of the catch portion 50, thereby rotating the latch member 42 away.

When the stop pin 74 passes below the catch portion 50, the center of gravity 64 urges the latch member 42 back toward the latch receiver 46. The catch portion 50 then returns to the latched position shown in FIGS. 4 and 5.

Figure 8:
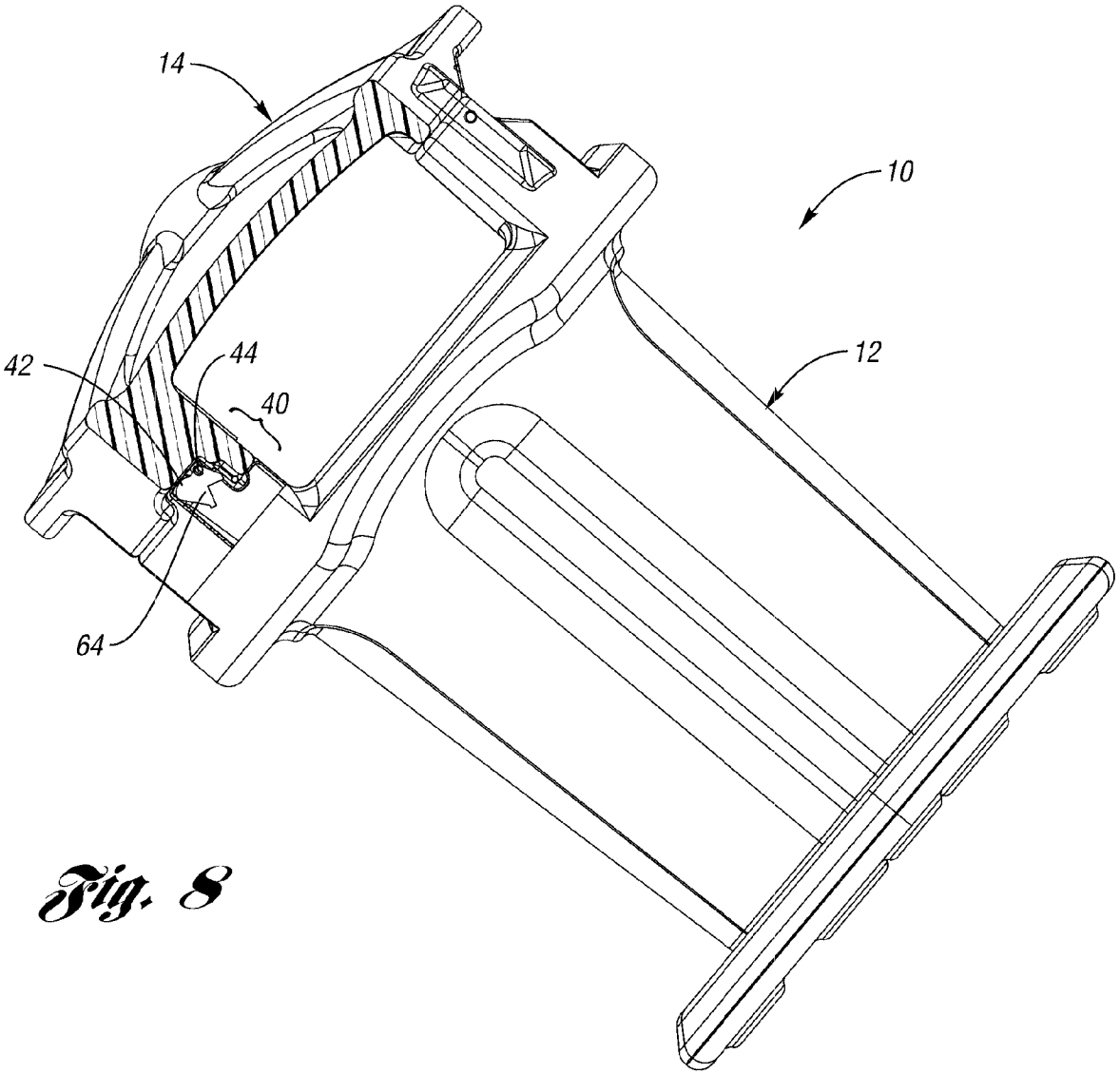
FIG. 8 is a side view of the litter bin of FIG. 2 being tilted to one side to release the latch.
Figure 9:
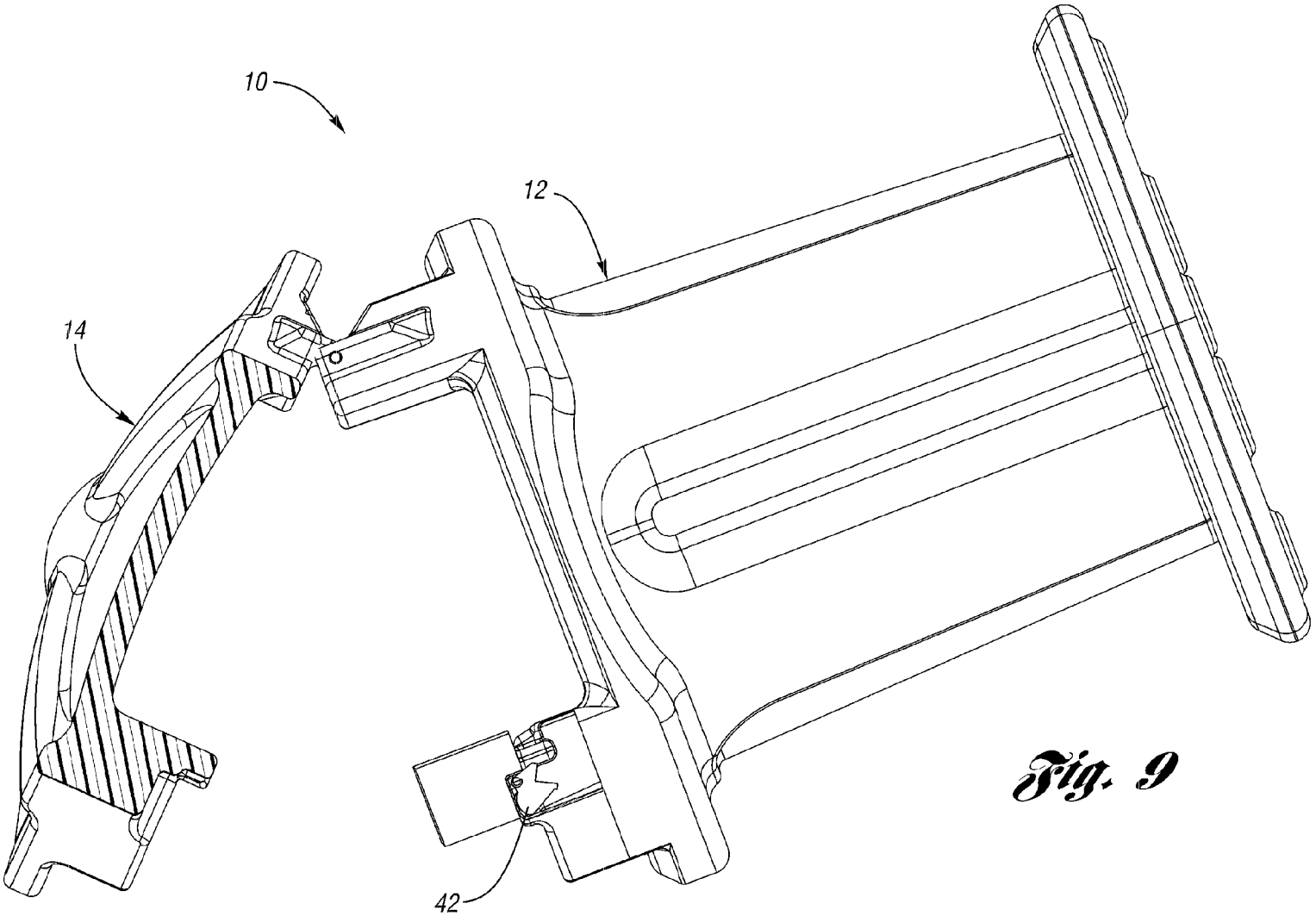
FIG. 9 shows the litter bin of FIG. 8 in a position to be emptied, with the lid hinged open.

To subsequently release the latch system 40, the litter bin 10 is tilted forward toward the latch system 40 as shown in FIG. 8. This causes the latch member 42 to pivot relative to the litter bin 10, to keep the center of gravity 64 of the latch member 42 below the pivot pin 44. This releases the latch system 40, and the lid 14 can be opened and the container 12 can be emptied as shown in FIG. 9.

Because the latch system 40 is gravity-actuated, the lid 14 is released automatically simply by tilting the litter bin 10 while emptying it. Therefore, automated handling equipment need only lift and tilt the litter bin 10 to empty it, without having to actuate the latch system 40 separately.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention. There are different designs of containers that would benefit from the present invention.

What is claimed is:

1. A litter bin comprising:

a container having a wall defining an interior and an opening to the interior, a lid for selectively covering the opening;

a hinge connecting the lid to the container; and a latch system opposite from the hinge and enclosed within the lid and the container for selectively securing the lid to the container, the latch system comprising:

a latch member pivotable about a pivot point from a first position to a second position in a second rotational direction and pivotable from the second position to the first position in a first rotational direction, the latch member including:

a catch portion having an inclined leading surface adjacent a shoulder, the catch portion impeding movement of the lid away from the container when the latch member is in the first position and the catch portion permitting movement of the lid away from the container when the latch member is in the second position, the latch member movable by gravity in the second rotation direction to the second position by tilting the litter bin, the latch member mounted to one of the container and the lid, a leg portion extending from the pivot point, the leg portion contacting a first stop when the latch member is pivoted in the first rotational direction, the first stop limiting pivoting of the latch member in the first rotational direction; and an abutment contacting a second stop when the latch member is pivoted in the second rotational direction, the second stop limiting pivoting of the latch member in the second rotational direction; and, a latch receiver mounted on the other of the container and the lid, the latch receiver including a pair of arms defining a recess and a pin extending between the arms, the latch receiver contacting the inclined leading surface of the catch portion to move the latch member in the second rotational direction to the second position when the lid is moved into a closed position on the container;

wherein the latch member is urged in the first rotational direction when the latch member is in the first position and when impeding movement of the lid during an attempt to open the lid.

2. The litter bin of claim 1 wherein the catch portion is received in the latch receiver when the latch member is in the first position.

3. The litter bin of claim 1 wherein the catch portion of the latch member rotates in the first rotational direction when impeding movement of the lid.

4. The litter bin of claim 1, the latch member having a center of gravity spaced from the pivot point.

5. The litter bin of claim 4 wherein the center of gravity of the latch member is spaced away from the catch portion.

6. The litter bin of claim 1, wherein the latch member pivots to the first position when the litter bin is in an upright position.

7. The litter bin of claim 6 wherein the latch member pivots to the second position when the litter bin is in a tilted position being tilted away from the upright position.

8. A litter bin comprising:

a container having a wall defining an upper opening to an interior of the container at a top of the wall;

a lid for selectively covering the opening;

a hinge connecting the lid to the container;

a latch system enclosed within the lid and the container opposite from the hinge for selectively locking the lid to the container over the opening, the latch system comprising:

a latch member having a center of gravity spaced beneath a pivot point and a catch portion movable in a first rotational direction to a first position from a second position and in a second rotational direction from the first position to the second position, the catch portion pivotable about the pivot point in the second rotational direction by tilting the litter bin from an upright orientation to a tilted orientation, the pivot point being closer to the top of the wall than the catch portion when the latch member is in the first position, the catch portion is urged in a first rotational direction when impending movement of the lid; and a latch receiver movable relative to the latch member, the latch receiver receiving the catch portion when the latch member is in the first position, the latch member mounted on one of the container and the lid, the latch receiver mounted on the other of the container and the lid, the latch receiver including:

a pair of arms defining a recess, the catch portion received in the recess in the first position, the catch portion impeding movement of the lid away from the container when the catch portion is in the first position and permitting movement of the lid away from the container when the catch portion is in the second position; and, a stop pin extending between the pair of arms, the stop pin contacting the catch portion to impede opening the lid when the latch member is in the first position.

9. The litter bin of claim 8, wherein the catch portion includes an inclined leading surface adjacent a shoulder, the latch receiver including a stop contacting the shoulder when the catch portion is in the first position.

10. The litter bin of claim 9 wherein the stop of the latch receiver contacts the inclined surface of the catch portion to move the latch member from the first position to the second position when the lid is moved into a closed position on the container.

11. A litter bin comprising:

a container having a wall defining an interior and an opening to the interior at the top of the wall;

a lid for selectively covering the opening; and a latch system enclosed within the lid and the container for selectively connecting the lid to the container, the latch includes:

a latch member and a latch receiver, the latch member mounted on one of the container and the lid, the latch receiver mounted on the other of the container and the lid, the latch member pivotable between a first position and a second position, the latch member pivotable from the second position to the first position in a first rotational direction and from the first position to the second position in a second rotational direction, the latch member including:

a catch portion that is positioned in a first direction from a stop on the latch receiver to contact the stop and to impede movement of the lid away from the container when the latch member is in the first position, the catch portion permitting movement of the lid away from the container when the latch member is in the second position, the latch member pivotable about a pivot point higher than the stop by gravity in the second rotational direction to the second position by tilting the litter bin, the pivot point being offset from the catch portion such that lifting the lid when the latch member is in the first position urges the latch member in the first rotational direction; and a leg portion extending downward from the pivot point when the latch member is in the first position, the leg portion contacting the container to limit rotation of the latch member in the first rotational direction upon attempting to lift the lid when the latch member is in the first position, the leg portion extending generally perpendicularly relative to the catch portion, a large recess defined between the leg portion and the catch portion.

* * * * *